US009975325B2

(12) United States Patent
Gaveglia et al.

(10) Patent No.: US 9,975,325 B2
(45) Date of Patent: May 22, 2018

(54) PRINTING UNIT FOR PRINTING PLATE ELEMENTS FROM PRINTING PLATES AND CONVERTING MACHINE COMPRISING SUCH A PRINTING UNIT

(71) Applicant: BOBST LYON, Villeurbanne (FR)

(72) Inventors: Serge Gaveglia, Villeurbanne (FR); Rémy Perenet, Cessieu (FR)

(73) Assignee: BOBST LYON (FR)

( * ) Notice: Subject to any disclaimer, the term of this patent is extended or adjusted under 35 U.S.C. 154(b) by 0 days. days.

(21) Appl. No.: 14/655,505

(22) PCT Filed: Dec. 19, 2013

(86) PCT No.: PCT/EP2013/003865
§ 371 (c)(1),
(2) Date: Jun. 25, 2015

(87) PCT Pub. No.: WO2014/101992
PCT Pub. Date: Jul. 3, 2014

(65) Prior Publication Data

US 2015/0352833 A1 Dec. 10, 2015

(30) Foreign Application Priority Data

Dec. 28, 2012 (FR) ..... 12 62955

(51) Int. Cl.
*B41F 1/28* (2006.01)
*B41F 27/06* (2006.01)
*B41F 27/12* (2006.01)

(52) U.S. Cl.
CPC ..... *B41F 27/06* (2013.01); *B41F 27/1206* (2013.01); *B41F 27/1231* (2013.01);
(Continued)

(58) Field of Classification Search
CPC ..... B41F 27/12; B41F 27/06; B41F 27/1206; B41F 27/1231; B41P 2200/12; B41P 2227/62; B41P 2227/63
See application file for complete search history.

(56) References Cited

U.S. PATENT DOCUMENTS 5,255,420 A * 10/1993 Maejima ..... B41F 27/1206 101/217
5,555,812 A * 9/1996 Ruckmann ..... B41F 27/1206 101/415.1
2005/0109228 A1* 5/2005 Iwamoto ..... B65H 5/025 101/477

FOREIGN PATENT DOCUMENTS

DE 10 2007 018936 A1 10/2008
EP 0 686 503 12/1995
(Continued)

OTHER PUBLICATIONS

International Search Report dated Mar. 12, 2014 issued in corresponding International patent application No. PCT/EP2013/003865.

*Primary Examiner* — Matthew G Marini
(74) *Attorney, Agent, or Firm* — Ostrolenk Faber LLP

(57) ABSTRACT

A printing unit for making prints from printing plates on plate elements conveyed by a transport system having at least one plate cylinder mounted rotatably and suitable for carrying initially at least one earlier printing plate and then at least one later printing plate, the printing unit includes a primary support suitable for supporting the later printing plate, in a standby configuration, during printing using the earlier printing plate and during the unwinding of the earlier printing plate, and in an engaged configuration, during the winding of the later printing plate onto the plate cylinder, a portion of the later printing plate being attached to the plate cylinder, and a secondary support suitable for supporting the earlier printing plate unwound from the plate cylinder, in
(Continued)

which the primary support includes a primary fastening member for fastening the later printing plate in the standby configuration, and a primary fastening mechanism for fastening the later printing plate in the engaged configuration.

12 Claims, 4 Drawing Sheets

(52) U.S. Cl.
CPC ..... *B41P 2200/12* (2013.01); *B41P 2227/62* (2013.01); *B41P 2227/63* (2013.01)

(56) References Cited

FOREIGN PATENT DOCUMENTS

| | | | | |
|---|---|---|---|---|
| EP | 0 714 771 | A2 | 6/1996 | |
| EP | 1 084 834 | A2 | 3/2001 | |
| EP | 1 084 841 | A1 | 3/2001 | |
| EP | 1 882 589 | A2 | 1/2008 | |
| EP | 2186638 | A2 * | 5/2010 | ..... B41F 27/005 |
| EP | 2 368 710 | A1 | 9/2011 | |

* cited by examiner

Fig. 3
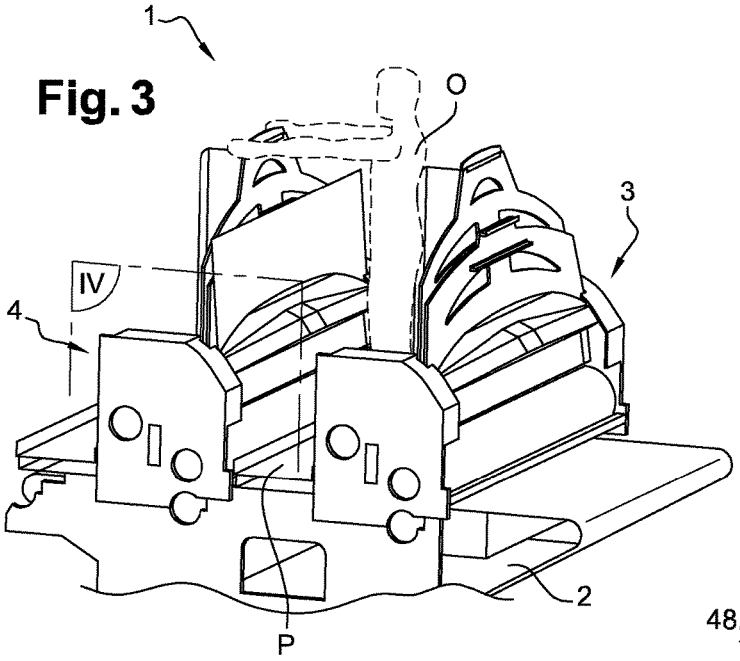
Fig. 4
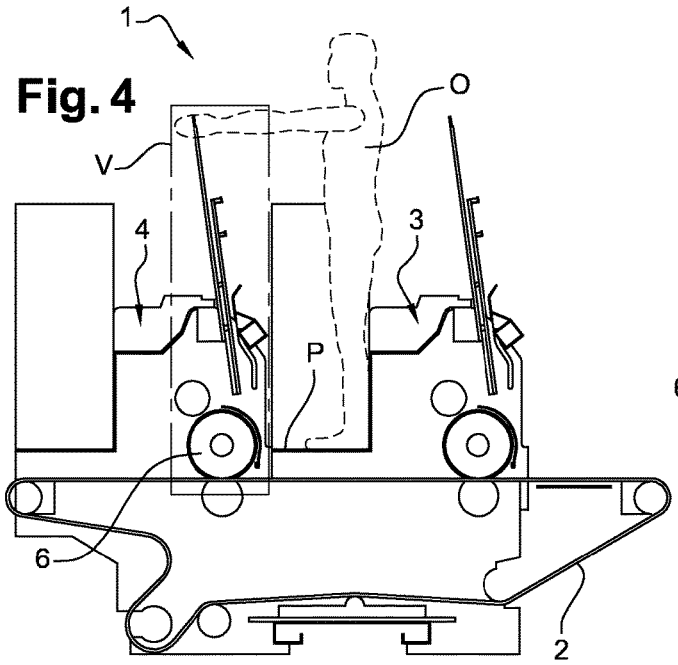
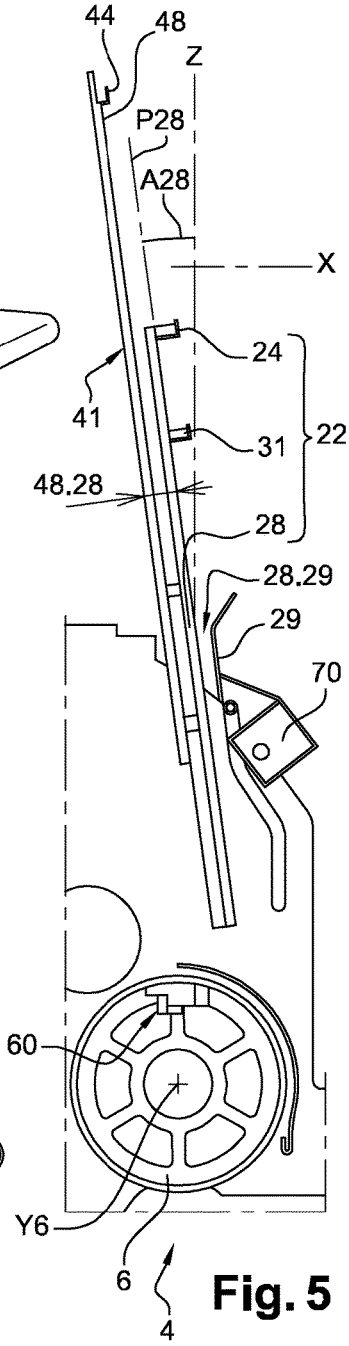
Fig. 5

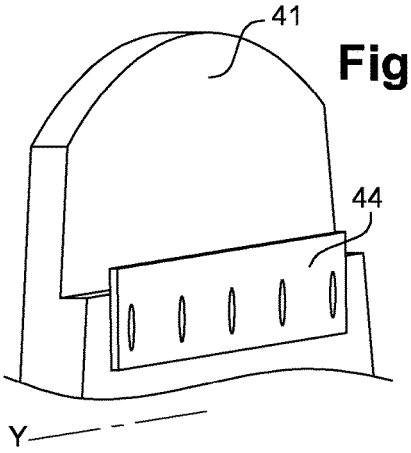
Fig. 6
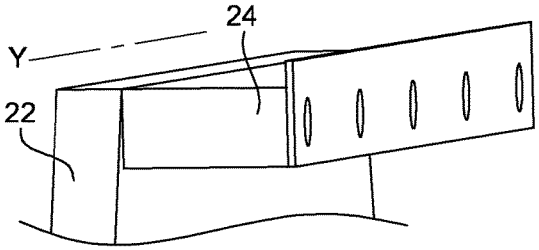
Fig. 7
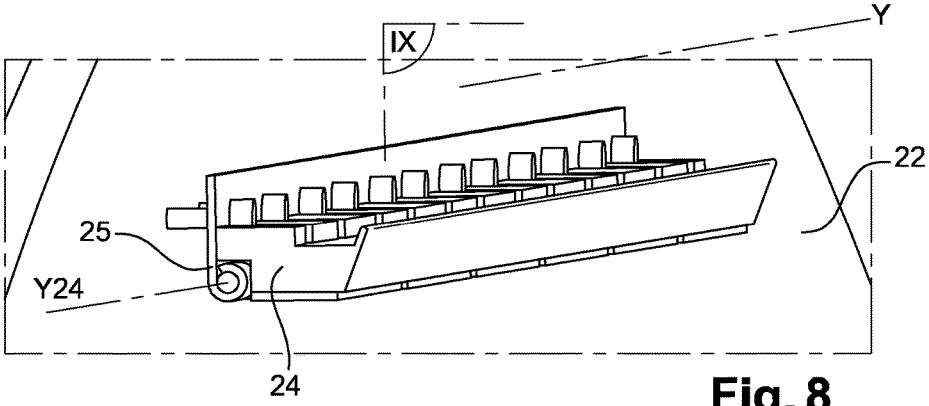
Fig. 8
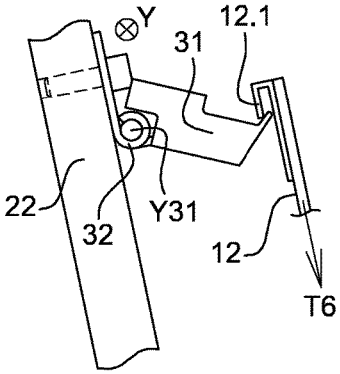
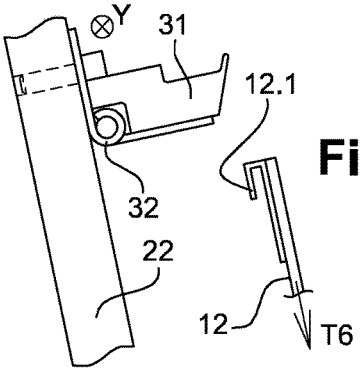
Fig. 10
Fig. 9
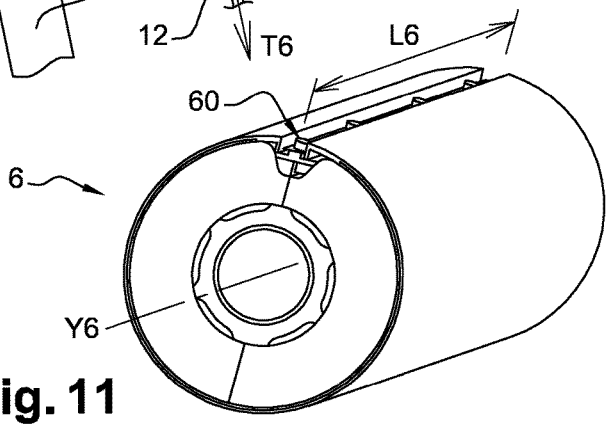
Fig. 11

PRINTING UNIT FOR PRINTING PLATE ELEMENTS FROM PRINTING PLATES AND CONVERTING MACHINE COMPRISING SUCH A PRINTING UNIT

CROSS-REFERENCE TO RELATED APPLICATIONS

The present application is a 35 U.S.C. § 371 national phase conversion of PCT/EP2013/003865, filed Dec. 19, 2013, which claims priority of French Application No. 1262955, filed Dec. 28, 2012. The contents of both applications are incorporated by reference herein. The PCT International Application was published in the French language.

FIELD OF INVENTION

The present invention relates to a printing unit for making prints from printing plates on plate elements conveyed by a transport system, and a converting machine comprising such a printing unit.

FIELD OF APPLICATION

The present invention can be applied to the field of processing plate elements, such as cardboard sheets, to form packaging boxes. The present invention can in particular be applied to converting machines, in particular machines combining printing, cutting, and folding/gluing.

Definitions

The term plate element refers to an overall flat product made of at least one material, such as paper, cardboard, or polymer, suitable for receiving a printed layer and for forming packaging containers. The term plate element thus refers to cardboard sheets, corrugated cardboard, laminated corrugated cardboard, cardboard plates, flexible plastic, such as polyethylene (PE), polyethylene terephthalate (PET), and bi-oriented polypropylene (BOPP).

BACKGROUND

EP 0'686'503 discloses a flexographic printing unit for making prints from printing plates on cardboard sheets conveyed by a transport system. The printing unit comprises a plate cylinder which is mounted so that it can rotate about a cylinder axis. The plate cylinder is suitable for carrying an earlier printing plate initially and then a later printing plate. In service, the plate cylinder is coated with ink which is to be deposited on the cardboard sheets. The transport system conveys the cardboard sheets into the printing unit and each cardboard sheet is pressed against the plate cylinder coated with ink.

The terms earlier and later are relative terms which refer to a chronological sequence during the production phase. Thus, when the printing unit is in service, the plate cylinder initially carries an earlier printing plate for making prints, and then the plate cylinder carries a later printing plate for making the following prints. This later printing plate then becomes an earlier printing plate when it is carried by the plate cylinder because another later printing plate will then be used.

In order to change the printing pattern on the cardboard sheets, it is necessary to replace the earlier printing plate, which is wrapped around the plate cylinder and defines the earlier printing pattern, with a later printing plate, which defines a later, different, printing pattern. To do this, an operator must successively climb onto the printing unit, remove the earlier printing plate, get down from the printing unit, place the earlier printing plate beside the converting machine, pick up the later printing plate, climb back onto the printing unit, and position the later printing plate. Sometimes a second operator is brought in to assist the first operator.

The earlier and later printing plates are large-sized and typically take the form of rectangles with sides that are often greater than 1 m or even 2 m. These printing plates are made from a fairly heavy flexible material. It is consequently difficult for an operator to handle these printing plates.

It thus takes a relatively long time to replace an earlier printing plate in the printing unit. This replacement time forms a significant portion of the downtime of the converting machine. Now a long downtime reduces the production volume and the profitability of the machine, in particular for converting machines producing a large number of small runs, where the printing plates are replaced frequently. Conversely, bringing in two operators to replace a printing plate increases the production cost even more when these replacements are frequent.

SUMMARY OF THE INVENTION

The present invention aims in particular to overcome the abovementioned problems wholly or partly.

To do this, the subject of the invention is a printing unit for making prints from printing plates on plate elements conveyed by a transport system. The printing unit comprises at least one plate cylinder mounted rotatably and suitable for carrying initially at least one earlier printing plate and then at least one later printing plate. The printing unit comprises:

- a primary support suitable for supporting the later printing plate, in a standby configuration, during printing using the earlier printing plate and during the unwinding of the earlier printing plate, and in an engaged configuration, during the winding of the later printing plate onto the plate cylinder, a portion of the later printing plate being attached to the plate cylinder; and

- a secondary support suitable for supporting the earlier printing plate unwound from the plate cylinder.

The primary support further comprises at least:

- a primary fastening member for fastening the later printing plate in the standby configuration, and
- a primary fastening mechanism for fastening the later printing plate in the engaged configuration.

Such a printing unit thus allows an operator to position a large-sized plate on his own. The number of operators required to replace an earlier printing plate is minimized so as to reduce the time taken to replace an earlier printing plate. This is particularly advantageous for converting machines producing a large number of small runs where the printing plates are replaced frequently.

According to an embodiment of the invention, the primary fastening member is suitable for cooperating, by virtue of complementary shapes, with at least one hook joined to the later printing plate. Such a primary fastening member thus allows the operator to fasten the later printing plate very quickly to the primary support.

According to an embodiment of the invention, the primary fastening member is formed by a tab extending substantially parallel to the cylinder axis, the tab having an L-shaped cross-section which points upward when the printing unit is in service. Such a tab thus makes it possible for the primary fastening member to be made with a low weight and at low cost. As an alternative to this embodiment, the primary fastening member can be formed by a clamping member, magnets, electromagnets, suction or an electrostatic force, etc.

According to an alternative embodiment, the secondary support comprises a secondary fastening member suitable for cooperating, by virtue of complementary shapes, with at least one hook joined to the earlier printing plate. Such a secondary fastening member thus allows the operator to fasten the earlier printing plate very quickly to the secondary support. In this alternative embodiment, the secondary member is advantageously formed by a tab having an L-shaped cross-section which points upward when the printing unit is in service. Such a tab thus makes it possible for the primary fastening member to be made with a low weight and at low cost.

According to an embodiment of the invention, the primary fastening mechanism can move between an engaged configuration of the later printing plate and an unfastened configuration of the later printing plate. The primary fastening mechanism comprises a hinge so that it can pivot about a direction of pivoting, which is substantially parallel to the plate cylinder, and an elastic biaising member arranged to biais the primary fastening mechanism from the unfastened configuration to the engaged configuration after the later printing plate has been wound onto the plate cylinder.

In other words, it is the rotation of the plate cylinder that pulls the later printing plate and hence unfastens it automatically from the primary fastening mechanism because the traction exerted by the plate cylinder is greater than the force of the elastic biaising member. After the later printing plate has been wound onto the plate cylinder, the elastic biaising member restores the primary fastening mechanism to the standby configuration in which the operator can fasten a new later printing plate.

According to an alternative of this embodiment, the elastic biaising member is formed by a helical torsion spring. Such a helical torsion spring thus makes it possible to make the elastic biaising member with a low weight and at low cost.

According to an embodiment, the primary support comprises a primary panel suitable for supporting the later printing plate substantially within a primary plane which is inclined at a primary angle that lies between 5 degrees and 30 degrees relative to a vertical direction. Such a primary support is thus compact in the direction of transport of the plate elements, which reduces the bulk of the printing unit.

According to an embodiment of the invention, the primary support is designed such that, in the standby configuration, the lower portion of the later printing plate is situated at a distance of less than 50 mm, preferably less than 30 mm, from the plate cylinder. Such a primary support thus makes it possible to place the later printing plate very close to the plate cylinder, which minimizes the time required to shift between the standby configuration and the engaged configuration.

According to an embodiment of the invention, the secondary support comprises a secondary panel suitable for supporting the earlier printing plate. The secondary panel extends substantially parallel to the primary panel. The distance between the secondary panel and the primary panel, measured perpendicularly to the primary panel, is less than 100 mm, preferably less than 50 mm. The secondary panel is designed to protrude above the primary panel when the printing unit is in service. The assembly formed by the primary support and the secondary support is thus particularly compact in the direction of transport of the plate elements. Moreover, because the secondary panel protrudes, the operator can fix the earlier printing plate to it easily.

According to an embodiment of the invention, the guide means further comprise guides designed to allow the later printing plate to slide toward the plate cylinder, that portion of the later printing plate which is attached to the plate cylinder in the engaged configuration being the lower portion of the later printing plate. Such guide means thus make it possible to position the later printing plate precisely with a view to it being wound onto the plate cylinder.

According to an embodiment of the invention, the guides comprise a primary sheet arranged substantially parallel to the primary panel so as to define, with the primary panel, a gap which is suitable for the passage of the later printing plate. Such a primary sheet thus forms guide means with a low cost and a small bulk.

According to an embodiment of the invention, the plate cylinder further comprises a locking device suitable for locking the later printing plate in the engaged configuration on the plate cylinder, the locking device preferably being suitable for exerting a pneumatic action on the later printing plate, the printing unit furthermore comprising a control device configured to enable an operator successively to deactivate the locking device to unwind the earlier printing plate and then activate the locking device to fix the later printing plate on the plate cylinder.

In other words, after unlocking, the plate cylinder is freewheeling and the operator can finish unwinding the earlier printing plate by pulling it away from the plate cylinder. Such a locking device and such a control device thus make it easier for an earlier printing plate to be replaced by the operator, which reduces the time taken to replace an earlier printing plate. In practise, the control device can comprise a switch button which the operator pushes to deactivate the locking device and hence to unlock the earlier printing plate. Such a locking device thus makes it possible to attach or detach the earlier printing plate or the later printing plate to or from the plate cylinder quickly.

According to an embodiment of the invention, the printing unit further comprises a safety hood which is designed so that it can move between a safe position in which the safety hood covers the plate cylinder, and an engaged position in which the safety hood at least partially exposes the plate cylinder. Such a safety hood thus guarantees the safety of the operators during production, in other words when the plate cylinder is rotating. The safety hood is then retracted to allow the operator to access the plate cylinder and hence replace the earlier printing plate.

According to an alternative embodiment of the invention, the movement of the safety hood takes place automatically once the printing unit has been moved away from the transport system. In practise, the printing unit, with the plate cylinder, can be lifted above the transport system, for example by a mechanism consisting of cams and geared motors.

Furthermore, the subject of the present invention is a converting machine, such as a printing machine, for processing plate elements, the converting machine comprising a transport system. The converting machine comprises at least one printing unit according to the invention. Such a converting machine can thus be controlled by a single operator in spite of the large-sized printing plates. The present invention thus makes it possible to minimize the number of operators required to replace an earlier printing plate, and to reduce the time taken to replace an earlier printing plate. This is particularly advantageous for converting machines producing a large number of small runs, where the printing plates are replaced often.

The embodiments and the alternative embodiments mentioned above can be taken separately or in any technically acceptable combination.

BRIEF DESCRIPTION OF THE DRAWINGS

The invention will be clearly understood and its advantages will become apparent upon reading the following description, given by way of non-limiting example and made with reference to the attached drawings, in which:

FIG. 3 is a view in perspective of the part of the machine in FIG. 1;

FIG. 4 is a cross-section through the plane IV in FIG. 3;

FIG. 5 is an enlarged view of the detail V in FIG. 4, illustrating one of the printing units in FIG. 1;

FIGS. 6 to 8 are enlarged views of the details VI to VIII in FIG. 2;

FIG. 9 is a cross-section through the plane IX in FIG. 8, illustrating part of the printing unit in FIG. 5, with the later printing plate in the engaged configuration;

FIG. 10 is a view similar to FIG. 9, illustrating part of the printing unit in FIG. 5 in a subsequent position to the engaged configuration;

FIG. 11 is a view in perspective of the plate cylinder belonging to the printing unit in FIG. 5.

DETAILED EXPLANATION OF THE PREFERRED EMBODIMENTS

FIGS. 1 to 11 illustrate part of a converting machine 1 of the type for printing, folding and gluing, intended to process plate elements. In this case, the plate elements can be cardboard sheets.

Figure 1:
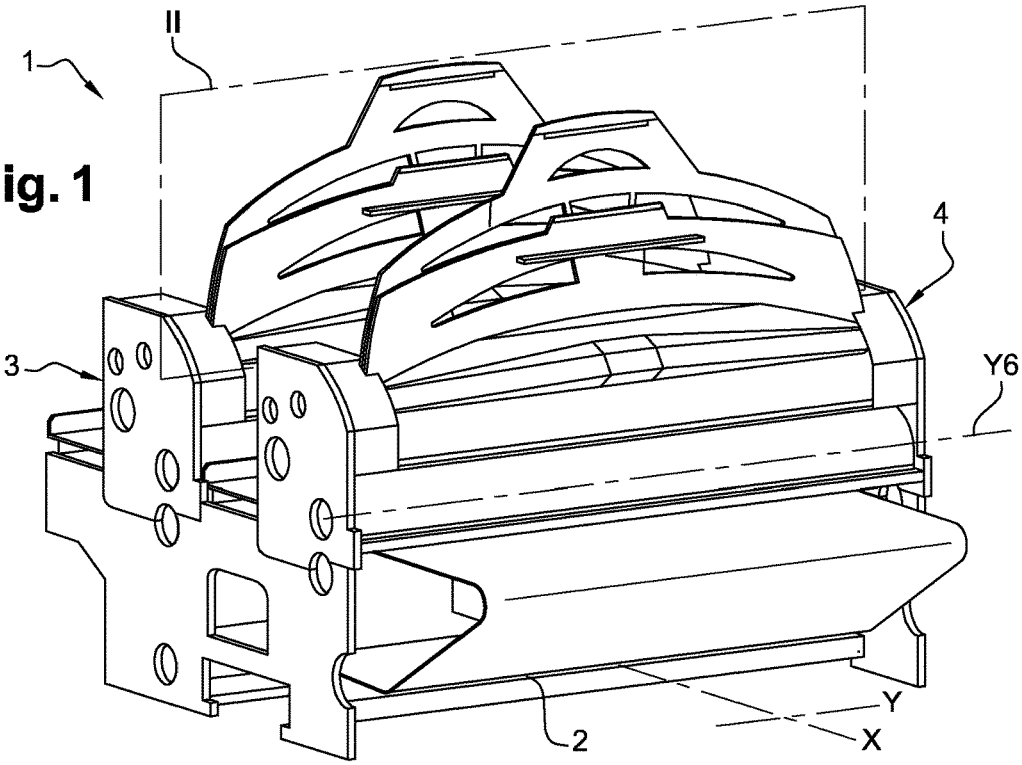
FIG. 1 is a view in perspective of part of a converting machine according to the invention, comprising two printing units according to the invention.

The converting machine 1 comprises a transport system 2 and two printing units 3 and 4, which can be seen in FIGS. 1, 3 and 4. The printing units 3 and 4 are flexographic printing units. The printing units 3 and 4 are intended for making prints from flexible printing plates on cardboard sheets (not shown).

These cardboard sheets are conveyed by the transport system 2 in a so-called pushing direction or longitudinal direction X. In order to do this, the transport system 2 has a transport belt and members for driving the transport belt.

As the printing units 3 and 4 are similar, only the printing unit 4 is described below. The printing unit 4 has a plate cylinder 6 which is mounted so that it can rotate about a cylinder axis Y6. When the plate cylinder 6 is in service, the cylinder axis Y6 is parallel to a transverse direction Y which is perpendicular to the longitudinal direction X.

Figure 13:
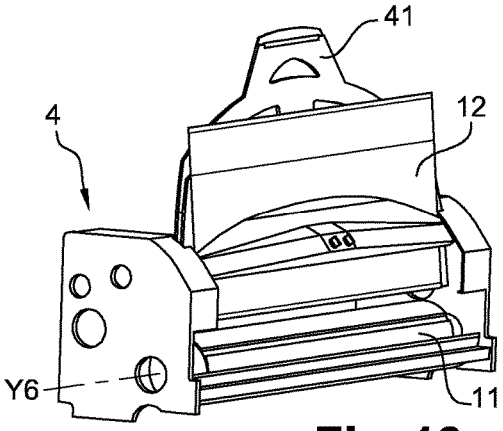

As shown in the sequence illustrated in FIGS. 12 to 17, the plate cylinder 6 is suitable for carrying initially at least one so-called earlier printing plate 11 and then at least one so-called later printing plate 12, as shown in particular by comparison of FIGS. 13 and 16.

The plate cylinder 6 is suitable for carrying earlier printing plates 11 and later printing plates 12 that are approximately 1.5 m wide. The plate cylinder 6 has a width L6 of approximately 2.2 m, measured along the cylinder axis Y6. During production, the plate cylinder 6 rotates in order to transfer the ink onto each cardboard sheet to be printed. In the example in FIGS. 1 to 17, the plate cylinder 6 comprises a single roll.

The printing unit 4 also has a walkway P designed to allow an operator O to handle the earlier printing plates 11 and later printing plates 12 and to control the printing unit 4.

Figure 14:
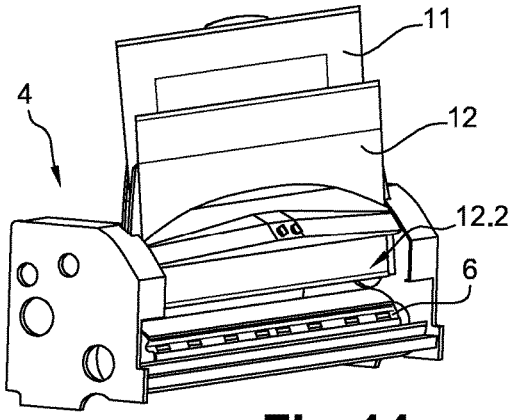
Figure 15:
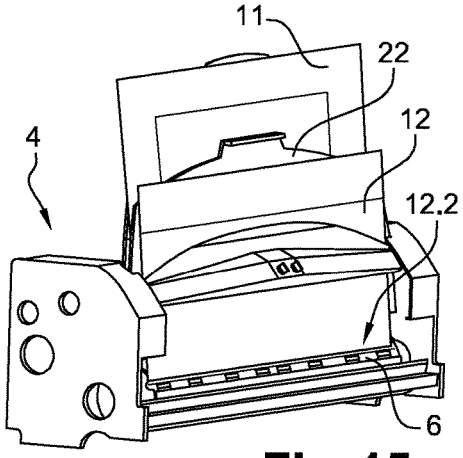

The printing unit 4 also has a primary support 22 which is suitable for supporting the later printing plate 12 before the later printing plate 12 is wound onto the plate cylinder 6 (FIGS. 12 to 15). Moreover, the printing unit 4 has a secondary support 41 which is suitable for supporting the earlier printing plate 11 after the earlier printing plate 11 has been unwound from the plate cylinder 6 (FIGS. 15 to 17).

The primary support 22 is suitable for supporting the later printing plate 12 in a so-called standby configuration (FIGS. 12, 13, and 14) during all or part of the time that prints are made from the earlier printing plate 11, and while the earlier printing plate 11 is being unwound. The primary support 22 is suitable for supporting the later printing plate 12 in a so-called engaged configuration (FIG. 15) while the later printing plate 12 is being wound onto the plate cylinder 6 and in which a portion of the later printing plate 12 is attached to the plate cylinder 6.

Figure 2:
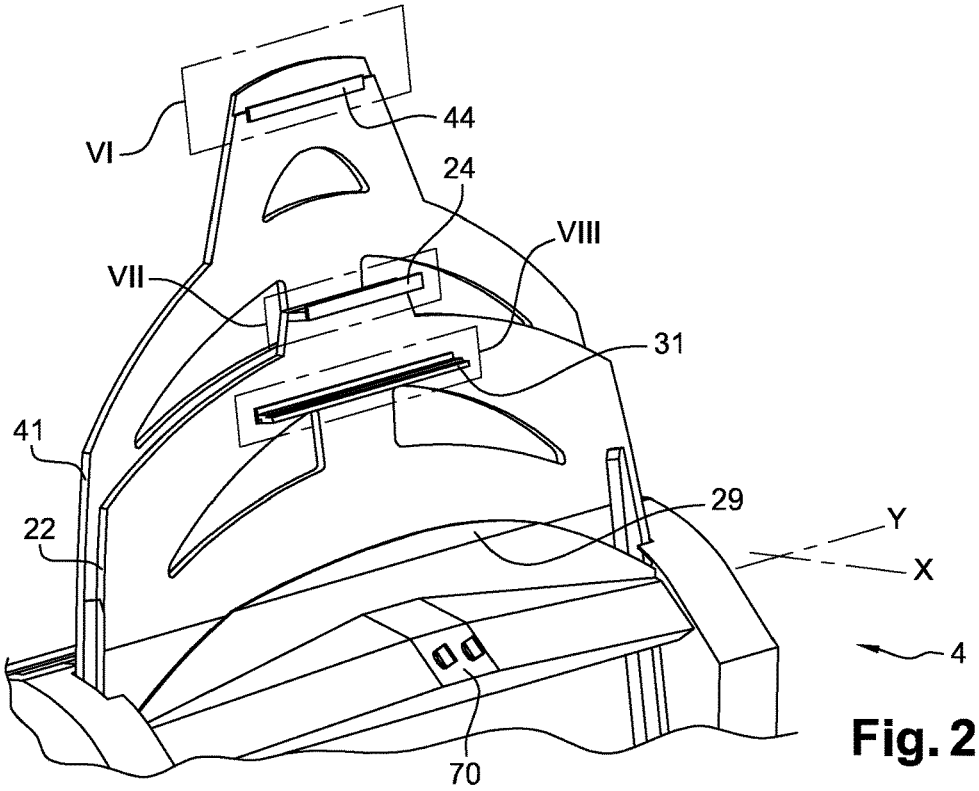
FIG. 2 is an enlarged view of the detail II in FIG. 1.
Figure 12:
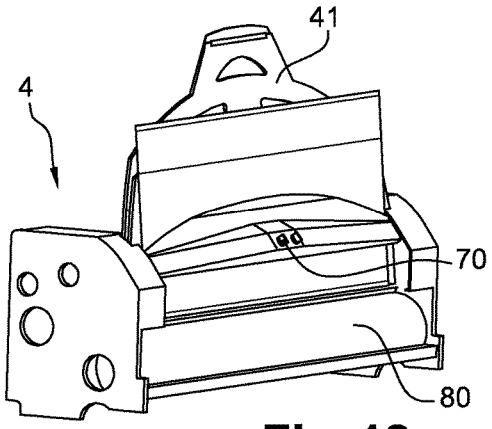
FIGS. 12 to 17 are views in perspective of the printing unit in FIG. 5, showing the different stages in extracting and unwinding an earlier printing plate and in engaging and winding on a later printing plate.

As shown in FIGS. 2 and 7, the primary support 22 comprises a primary fastening member 24 for fastening the later printing plate 12 in the standby configuration. The primary fastening member 24 is suitable for interacting, by virtue of complementary shapes, with a hook 12.1 joined to the later printing plate 12. The hook 12.1, which can be seen in FIGS. 9 and 10, is arranged on the upper edge of the later printing plate 12.

The purpose of the primary fastening member 24 is to fasten the later printing plate 12 so that it is suspended in the standby configuration. The primary fastening member 24 thus enables the operator O to fasten the later printing plate 12 to the primary support 22 very quickly.

The primary fastening member 24 is here formed by a tab which extends substantially parallel to the cylinder axis Y6. This tab has a cross-section in the shape of an L which points upward when the printing unit 4 is in service (FIGS. 12 to 17).

Similarly, the secondary support 41 comprises a secondary fastening member 44 which is suitable for interacting, by virtue of complementary shapes, with at least one hook joined to the earlier printing plate 11. The secondary fastening member 44 enables the operator O to fasten the earlier printing plate 11 to the secondary support 41 very quickly.

As shown in FIGS. 2 and 6, the secondary fastening member 44 is here formed by a tab having a cross-section in the shape of an L which points upward when the printing unit 4 is in service.

In the example of FIGS. 1 to 17, the primary support 22 also comprises a primary fastening mechanism 31 for fastening the later printing plate 12 in the engaged configuration. The primary fastening mechanism 31 can move between an engaged configuration of the later printing plate 12 and an unfastened configuration of the later printing plate 12.

The primary fastening mechanism 31 is hinged and comprises a hinge so that it can pivot about a direction of pivoting Y31 substantially parallel to the plate cylinder 6, i.e. substantially parallel to the transverse direction Y. As shown in FIG. 8, the primary fastening mechanism 31 is here formed by a tab equipped with a hook which points upward when the printing unit 4 is in service.

Furthermore, the hinged primary fastening mechanism 31 here comprises an elastic biaising member 32 designed to return this same primary fastening mechanism 31 from the unfastened configuration to the engaged configuration (FIG. 15) after the later printing plate 12 has been wound onto the plate cylinder 6. The elastic biaising member 32 is here formed by a helical torsion spring.

The hinge Y31 pivots the primary fastening mechanism 31 between a position corresponding to the engaged configuration (FIG. 9) and a position in which the later printing plate 12 is freed (FIG. 10) and the hooked tab of the primary fastening mechanism 31 no longer retains the later printing plate 12. After the later printing plate 12 has been freed, the elastic biaising member 32 restores the primary fastening mechanism 31 into the engaged configuration.

The primary support 22 also comprises a primary panel 28 which is suitable for supporting the later printing plate 12 substantially in a primary plane P28. As shown in FIG. 5, the primary plane P28 is inclined at a primary angle A28 that lies between 5 degrees and 30 degrees, preferably approximately 10 degrees, with respect to a vertical direction Z. The later printing plate 12 can thus slide on the primary panel 28 after having been unfastened from the primary fastening member 24.

As shown in FIG. 14, the primary support 22 is designed such that, in the standby configuration, the lower portion 12.2 of the later printing plate 12 is situated at a distance of 0 mm from the plate cylinder 6. In other words, the lower portion 12.2 is aligned with the plate cylinder 6. The primary support 22 thus makes it possible to place the later printing plate 12 very close to the plate cylinder 6, which minimizes the time required to move the later printing plate 12 between the standby configuration (FIG. 14) and the engaged configuration (FIG. 15). In order to minimize the time required to mount the later printing plate 12, the plate cylinder 6 is held in an angular position that coincides substantially with the position of the lower portion 12.2 of the later printing plate 12. In this angular position, the plate cylinder 6 is ready to receive the later printing plate 12 directly.

The secondary support 41 comprises a secondary panel 48 which is suitable for supporting the earlier printing plate 11. The secondary panel 48 extends substantially parallel to the primary panel 28. The distance 48.28 between the secondary panel 48 and the primary panel 28, measured perpendicularly to the primary panel 28, is here approximately 30 mm. Furthermore, as shown in FIG. 5, the secondary panel 48 is designed so as to protrude above the primary panel 28 when the printing unit 4 is in service.

The assembly formed by the primary support 22 and the secondary support 41 is thus particularly compact in the direction of transport X of the cardboard sheets. Furthermore, because the secondary panel 48 protrudes, the operator O can easily fix the earlier printing plate 11 to it.

In the example of FIGS. 1 to 17, the primary panel 28 and the secondary panel 48 are made from polymethyl methacrylate (PMMA). The primary panel and the secondary panel can thus be strong and transparent, which makes it easier for the operator O to view and hence position the later printing plate 12.

The primary support 22 also comprises guide means with guides designed to allow the later printing plate 12 to slide toward the plate cylinder 6. The later printing plate 12 is attached by its lower portion 12.2 to the plate cylinder in the engaged configuration (FIG. 15). Because the lower portion 12.2 and the plate cylinder 6 coincide, the later printing plate 12 can be positioned very precisely with a view to winding it (FIG. 16) onto the plate cylinder 6.

As shown in FIG. 5, these guides here comprise a primary plate 29 which is arranged substantially parallel to the primary panel 28 to define, with the primary panel 28, a gap 28.29 which is suitable for the passage of the later printing plate 12. When the later printing plate 12 slides toward the plate cylinder 6, the later printing plate 12 passes through the gap 28.29.

In the example of FIGS. 1 to 17, the movement of the later printing plate 12 between the standby configuration (FIG. 14) and the engaged configuration (FIG. 15) is relatively long. Alternatively, the guide means can be designed to guide the later printing plate 12 in a very short movement. In this alternative embodiment, the standby configuration and the engaged configuration are close to each other, and may even coincide.

Advantageously, in this alternative embodiment, the guide means are suitable for guiding the later printing plate 12 in a movement directed solely from the standby configuration (FIG. 14) toward the engaged configuration 16. The guide means are thus relatively simple because they are not provided for return movement from the engaged configuration to the standby configuration.

The plate cylinder 6 also comprises a locking device 60 suitable for locking the later printing plate 12 in the engaged configuration (FIG. 15) on the plate cylinder 6. The locking device 60 is described in detail in the document EP 0'686'503. In this case, the locking device 60 exerts a pneumatic action on the later printing plate 12.

As shown in FIGS. 2 and 5, the printing unit 4 also comprises a control device 70 which is configured so as to allow the operator O successively to deactivate the locking device 60, in order to unwind the earlier printing plate 11, and then activate the locking device 60, in order to fix the later printing plate 12 on the plate cylinder 6.

Thus, after unlocking, the plate cylinder 6 is freewheeling and the operator O can finish unwinding the earlier printing plate 11 by pulling it away from the plate cylinder 6. The control device 70 here comprises a switch button which the operator O pushes to deactivate the locking device 60 and hence to unlock the earlier printing plate 11.

The printing unit 4 also comprises a safety hood 80 which is designed so that it can move between a safe position (FIG. 12 or 17) in which the safety hood 80 covers the plate cylinder 6, and an engaged position (FIGS. 13 to 16) in which the safety hood 80 exposes the plate cylinder 6.

The safety hood 80 guarantees the safety of the operators during production, in other words when the plate cylinder 6 is rotating.

The safety hood 6 is retracted to allow the operator O to access the plate cylinder 6 in order to replace the earlier printing plate 11.

The movement of the safety hood 80 can take place automatically once the printing unit 4 has been moved away from the transport system 2. In practice, the printing unit 4, with the plate cylinder 6, can be lifted above the transport system 2 by a mechanism consisting of cams and geared motors.

In service, the converting machine 1 is initially in a production phase in which the transport system 2 brings the cardboard sheets in the printing unit 4 into contact with the ink-coated plate cylinder 6. In this production phase, the printing unit 4 is in the lower position, with the plate cylinder 6 level with the transport system 2.

In order to change the printing patterns, the operator O has to replace the earlier printing plate 11 with the later printing plate 12, following these steps:

During the production phase, as a background task, the operator O climbs onto the walkway P with the later printing plate 12. The safety hood 80 is closed.

The operator O installs the later printing plate 12 in the standby configuration (FIG. 12) by fastening the later printing plate 12 to the primary fastening member 24.

The operator O interrupts production and controls the rising of the printing unit 4 toward a raised position relative to the transport system 2. The opening of the safety hood 80 is controlled automatically, for example servo-controlled by the rising of the printing unit 4 (FIG. 13).

The operator O deactivates, using the control device 70, the locking device 60 so as to detach the earlier printing plate 11 from the plate cylinder 6.

The operator O unwinds the earlier printing plate 11, then lays it on the secondary panel 48 and fastens it to the secondary fastening member 44 (FIG. 14).

The operator O moves the later printing plate 12 from its standby configuration into its engaged configuration (FIG. 15). In order to do this, the operator O unfastens the later printing plate 12 from the primary fastening member 24 and then fastens it to the primary fastening mechanism 31.

The operator O places the lower portion 12.2 of the later printing plate 12 on the plate cylinder 6. The weight of the later printing plate 12 is supported by the primary panel 28.

The operator O activates, using the control device 70, the locking device 60 in order to fix the later printing plate 12 to the plate cylinder 6 in order to allow the later printing plate 12 to be wound onto the plate cylinder 6. While the later printing plate 12 is being wound onto the plate cylinder 6, the upper part of the later printing plate 12 slides along the primary panel 28.

The operator O controls, using the control device 70, the rotation of the plate cylinder 6, which completes the winding of the later printing plate 12 onto the plate cylinder 6. The rotation of the plate cylinder 6 exerts a traction T6 (FIGS. 9 and 10) on the later printing plate 12, which automatically unfastens the later printing plate 12 from the primary fastening mechanism 31 because the traction T6 is greater than the torque exerted by the elastic biaising member 32.

Figure 16:
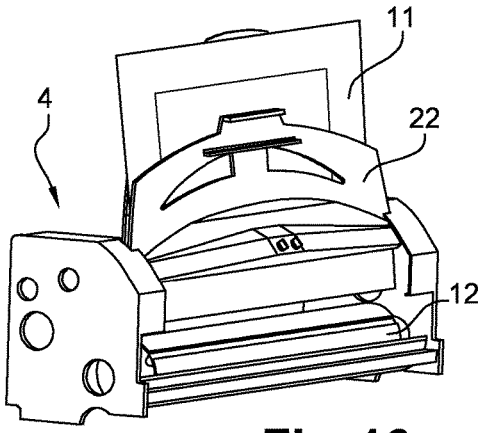
Figure 17:
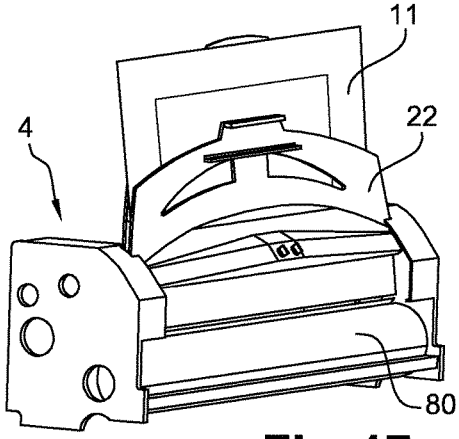

The operator O activates, using the control device 70, the locking device 60 in order to fix the upper portion of the later printing plate 12 to the plate cylinder 6 (FIG. 16). After the later printing plate 12 has been wound onto the plate cylinder 6, the elastic biaising member 32 restores the primary fastening mechanism 31 into the standby configuration (FIG. 8) in which the operator O can fasten a new later printing plate 12.

The operator O controls the lowering of the printing unit 4 into the production position in which the plate cylinder 6 is level with the transport system 2. The closing of the safety hood 80 is controlled automatically, for example servo-controlled by the lowering of the printing unit 4 (FIG. 17).

The converting machine 1 can again produce products in order to print the design of the later printing plate 12 on the next cardboard sheets.

The printing unit 4 can thus allow the operator O to extract a large-sized earlier printing plate 11 alone and position a large-sized later printing plate 12 alone.

The invention claimed is:

1. A printing unit for making prints from printing plates on plate elements conveyed by a transport system, having at least one plate cylinder mounted rotatably and suitable for carrying initially an earlier printing plate for making a first print and then a later printing plate for making a second print, comprising:

a primary support suitable for supporting the later printing plate, the later printing plate presenting successively a standby and an engaged configuration, the later printing plate being in the standby configuration during printing using the earlier printing plate and during the unwinding of the earlier printing plate from the plate cylinder after printing using the earlier printing plate, and the later printing plate being in the engaged configuration during the winding of the later printing plate onto the plate cylinder, a portion of the later printing plate being attached to the primary support; and a secondary support suitable for supporting the earlier printing plate unwound from the plate cylinder after printing using the earlier printing plate, wherein the primary support further comprises at least, a primary fastening member for fastening the later printing plate in the standby configuration, the primary fastening member being placed on a first upper position on the primary support, and a primary fastening mechanism for fastening the later printing plate in the engaged configuration, the primary fastening mechanism being placed on a second upper position on the primary support spaced from the first upper position, the later printing plate being movable from the standby configuration to the engaged configuration by being unfastened from the primary fastening member and then fastened to the primary fastening mechanism, and wherein the secondary support further comprises, a secondary fastening member for fastening the earlier printing plate, the secondary fastening member being placed on an upper position on the secondary support, and wherein the primary support and the secondary support are static relative to the plate cylinder, and each of the printing plates is grasped at its upper part to hang down from the primary fastening member, primary fastening mechanism and secondary fastening member.

2. A printing unit according to claim 1, wherein the primary fastening member is suitable for interacting, by virtue of complementary shapes, with at least one hook joined to the later printing plate.

3. A printing unit according to claim 2, wherein the primary fastening member is formed by a tab extending substantially parallel to the cylinder axis, the tab having an L-shaped cross-section which points upward when the printing unit is in service.

4. A printing unit according to claim 1, wherein the primary fastening mechanism can move between an engaged configuration of the later printing plate and an unfastened configuration of the later printing plate.

5. A printing unit according to claim 4, wherein the primary fastening mechanism comprises, a hinge so that it can pivot about a direction of pivoting which is substantially parallel to the plate cylinder; and an elastic biaising member designed to return the primary fastening mechanism from the unfastened configuration to the engaged configuration after the later printing plate has been wound onto the plate cylinder.

6. A printing unit according to claim 1, wherein the primary support comprises a primary panel suitable for supporting the later printing plate substantially within a primary plane which is inclined at a primary angle that lies between 5° and 30° relative to a vertical direction.

7. A printing unit according to claim 6, wherein the secondary support comprises a secondary panel suitable for supporting the earlier printing plate, extending substantially parallel to the primary panel and designed to protrude above the primary panel.

8. A printing unit according to claim 1, wherein the primary support comprises guide means with guides designed to allow the later printing plate to slide toward the plate cylinder, and wherein a portion of the later printing plate which is attached to the plate cylinder in the engaged configuration is the lower portion of the later printing plate.

9. A printing unit according to claim 8, wherein the guides comprise a primary plate arranged substantially parallel to a primary panel to define, with the primary panel, a gap which is suitable for the passage of the later printing plate.

10. A printing unit according to claim 1, wherein the plate cylinder further comprises a locking device suitable for locking the later printing plate in the engaged configuration on the plate cylinder, and the printing unit further comprises a control device configured to enable an operator successively to deactivate the locking device to unwind the earlier printing plate and then activate the locking device to fix the later printing plate on the plate cylinder.

11. A printing unit according to claim 1, further comprising a safety hood which is designed so that it can move between a safe position in which the safety hood covers the plate cylinder, and an engaged position in which the safety hood at least partially exposes the plate cylinder.

12. A machine for processing plate elements, comprising at least one transport system, and at least one printing unit according to claim 1.

* * * * *